US007641142B2

(12) United States Patent
Tsai

(10) Patent No.: US 7,641,142 B2
(45) Date of Patent: Jan. 5, 2010

(54) MULTIPROCESSING APPARATUS FOR FORMING LOGS OF WEB MATERIAL

(75) Inventor: Tung-I Tsai, Singang Township (TW)

(73) Assignee: Chan Li Machinery Co., Ltd., Taipei (TW)

( * ) Notice: Subject to any disclaimer, the term of this patent is extended or adjusted under 35 U.S.C. 154(b) by 75 days.

(21) Appl. No.: 11/616,579

(22) Filed: Dec. 27, 2006

(65) Prior Publication Data

US 2007/0102562 A1 May 10, 2007

Related U.S. Application Data

(63) Continuation of application No. 11/081,110, filed on Mar. 16, 2005, now Pat. No. 7,222,813.

(51) Int. Cl.
*B65H 67/00* (2006.01)

(52) U.S. Cl. ..... 242/533.7

(58) Field of Classification Search ..... 242/533, 242/533.7, 533.2; 29/234, 407.1, 525, 819, 29/820, 822; 198/626.1, 626.3, 801
See application file for complete search history.

(56) References Cited

U.S. PATENT DOCUMENTS

| | | | | |
|---|---|---|---|---|
| 1,819,406 | A * | 8/1931 | Cannard et al. | 242/533.1 |
| 3,532,573 | A | 10/1970 | Herman | |
| 4,327,877 | A | 5/1982 | Perini | |
| 4,487,377 | A | 12/1984 | Perini | |
| 4,588,138 | A | 5/1986 | Spencer | |
| 4,723,724 | A | 2/1988 | Bradley | |
| 4,828,195 | A | 5/1989 | Hertel et al. | |
| 4,856,725 | A | 8/1989 | Bradley | |
| 4,909,452 | A | 3/1990 | Hertel et al. | |
| 4,962,897 | A | 10/1990 | Bradley | |
| 5,054,708 | A * | 10/1991 | Wiggers | 242/533.7 |
| 5,092,533 | A | 3/1992 | Gangemi | |
| 5,104,055 | A | 4/1992 | Buxton | |
| 5,137,225 | A | 8/1992 | Biagiotti | |
| 5,226,611 | A | 7/1993 | Butterworth et al. | |
| 5,248,106 | A | 9/1993 | Biagiotti | |
| 5,249,756 | A | 10/1993 | Biagiotti | |

(Continued)

FOREIGN PATENT DOCUMENTS

| | | |
|---|---|---|
| EP | 1440925 | 7/2004 |

(Continued)

OTHER PUBLICATIONS

Search Report for EP 05028461, Dec. 28, 2006, Chan Li Machinery Co., Ltd.

(Continued)

*Primary Examiner*—John Q. Nguyen
*Assistant Examiner*—William E Dondero
(74) *Attorney, Agent, or Firm*—Baker & McKenzie LLP

(57) ABSTRACT

A log multiprocessing apparatus winds a web material around a winding core to form a log. Once the log is about to be completed, the web material is severed to form a tail of the log, and a pattern including at least one glue layer is applied on the tail of the log. The log then is decelerated and the tail is pressed on the log to form a final sealed log of web material.

9 Claims, 12 Drawing Sheets

U.S. PATENT DOCUMENTS

| | | | | |
|---|---|---|---|---|
| 5,259,910 | A | 11/1993 | Biagiotti | |
| 5,267,703 | A | 12/1993 | Biagiotti | |
| 5,285,977 | A | 2/1994 | Biagiotti | |
| 5,368,252 | A | 11/1994 | Biagiotti | |
| 5,370,335 | A | 12/1994 | Vigneau | |
| 5,402,960 | A | 4/1995 | Oliver et al. | |
| 5,497,959 | A | 3/1996 | Johnson et al. | |
| 5,505,405 | A | 4/1996 | Vigneau | |
| 5,538,199 | A | 7/1996 | Biagiotti | |
| 5,542,622 | A | 8/1996 | Biagiotti | |
| 5,584,443 | A | 12/1996 | Butterworth | |
| 5,603,467 | A | 2/1997 | Perini et al. | |
| 5,639,046 | A | 6/1997 | Biagiotti | |
| 5,660,349 | A | 8/1997 | Miller et al. | |
| 5,681,421 | A | 10/1997 | Biagiotti | |
| 5,690,296 | A | 11/1997 | Biagiotti | |
| 5,769,352 | A | 6/1998 | Biagiotti | |
| 5,772,149 | A | 6/1998 | Butterworth | |
| 5,820,064 | A | 10/1998 | Butterworth | |
| 5,839,680 | A | 11/1998 | Biagiotti | |
| 5,839,688 | A | 11/1998 | Hertel et al. | |
| 5,853,140 | A | 12/1998 | Biagiotti | |
| 5,979,818 | A | 11/1999 | Perini et al. | |
| 6,000,657 | A | 12/1999 | Butterworth | |
| 6,050,519 | A | 4/2000 | Biagiotti | |
| 6,056,229 | A | 5/2000 | Blume et al. | |
| 6,129,304 | A | 10/2000 | Biagiotti | |
| 6,371,304 | B2 * | 4/2002 | Gambini | 209/620 |
| 6,372,064 | B1 | 4/2002 | Butterworth et al. | |
| 6,422,501 | B1 | 7/2002 | Hertel et al. | |
| 6,431,491 | B1 | 8/2002 | Biagiotti | |
| 6,497,383 | B1 | 12/2002 | Daul et al. | |
| 6,513,750 | B2 | 2/2003 | Miller | |
| 6,565,033 | B1 | 5/2003 | Biagiotti | |
| 6,595,458 | B1 | 7/2003 | Biagiotti | |
| 6,595,459 | B2 | 7/2003 | Hanson | |
| 6,648,266 | B1 | 11/2003 | Biagiotti et al. | |
| 6,659,387 | B2 | 12/2003 | Biagioni et al. | |
| 6,752,344 | B1 | 6/2004 | Biagiotti | |
| 6,926,950 | B2 | 8/2005 | Fernfors et al. | |
| 2003/0057314 | A1 * | 3/2003 | White | 242/533.7 |
| 2003/0189123 | A1 | 10/2003 | Biagiotti et al. | |
| 2004/0256513 | A1 | 12/2004 | Perini | |

FOREIGN PATENT DOCUMENTS

| | | |
|---|---|---|
| WO | WO95 15902 | 6/1995 |
| WO | WO97 32804 | 9/1997 |
| WO | WO99 02439 | 1/1999 |
| WO | WO99 42393 | 8/1999 |
| WO | WO01 64563 | 9/2001 |
| WO | WO2004 005173 | 1/2004 |
| WO | WO2004 028938 | 4/2004 |
| WO | WO2004 046006 | 6/2004 |

OTHER PUBLICATIONS

Search Report for EP 05028461, Feb. 22, 2007, Chan Li Machinery Co., Ltd.

* cited by examiner

MULTIPROCESSING APPARATUS FOR FORMING LOGS OF WEB MATERIAL

FIELD OF THE INVENTION

The present invention generally relates to the manufacture of logs or rolls of a web material, and more particularly to a multiprocessing apparatus and a process of forming logs of web material with sealed tails.

DESCRIPTION OF THE RELATED ART

Conventionally, the manufacture of rolls of toilet tissue, kitchen towels or like products requires a number of processing steps, including unwinding the web material from a log of a large diameter and rewinding it on a log of a same length but with a smaller diameter suitable for consumer's use. The unwinding and rewinding processes are usually conducted in a rewinding machine.

It is usually known that to be competitive, the rewinding process has to be highly automated and efficient with high rewinding speeds. In this regard, many technical features are currently developed and implemented in processing machines with variant degrees of successes.

PCT Application Publication No. WO 2004/046006, the disclosure of which is incorporated herein by reference, describes the construction of a log-processing apparatus that integrates a gluing device to seal the tail of the wound log. The gluing device is constructed from a rotary arm that operatively rotates to contact and apply a glue layer on the web material being fed along a winding roller. While applying the glue layer on the web material, the rotary arm also pinches on the web material to sever it along a perforation line and thereby form a tail of the log.

U.S. Pat. No. 6,000,657, the disclosure of which is also incorporated herein by reference, describes a variant construction of a log-processing machine provided with a log control system. The log control system includes at least two control fingers that operatively slide to convey a winding core to the log-winding unit, sever the web material to define a tail of the log, and push and unload the wound log that freely rolls toward a deceleration hood, respectively.

In U.S. Pat. No. 6,056,229, the disclosure of which is incorporated herein by reference, the log-processing machine includes a stationary plate mounted contiguous to a winding roller of the log-winding unit. The web material is fed along the stationary plate to the winding roller. A conveying arm slides to pinch against the web material on the stationary plate so that the web material tears off at an adjacent perforation line.

The processing apparatuses from the prior art have a number of disadvantages that call for improvements. For example, tail sealing is usually not achieved adequately because the tail applied with glue is not properly wound on the log after it is unloaded from the log-winding unit. This may result in a final log product that exhibits a coarse tail appearance because the adhesion between the tail and the log is not uniform.

Therefore, there is presently a need for a log multiprocessing apparatus that can integrate many functional operations in a single system capable of producing a final log product with an improved aesthetic appearance.

SUMMARY OF THE INVENTION

The present application describes a log multiprocessing apparatus and a process of forming logs of a web material.

In one embodiment, the log multiprocessing apparatus comprises a log-winding unit operable to wind a log from a winding core, a conveyor operable to deliver a winding core to the log-winding unit, a severing arm operable to cut out a tail of one tog, a glue applicator operable to dispense at least one glue layer on a part of the web material corresponding to the tail of one log, and a tail-processing unit operable to press and seal the tail of one log.

In some embodiments, the glue applicator includes a printing roller having a surface provided with one or more imprinting patterns configured to contact and dispense at least one portion of glue on a part of the web material. In some variant embodiments, the glue includes color glue.

In some variations, the log-winding unit includes a plurality of rotary winding elements. In other variations, the severing arm is slidable between a first position retracted in one rotary element and a second position where the severing arm thrusts against the web material to cut out a tail of a log being wound at the log-winding unit.

In some embodiments, the tail-processing unit includes a conveying belt, a guiding plate and two pressing rollers. In some variations, the conveying belt is operable to decelerate one log rolling along the guiding plate toward the two pressing rollers. In other variations, the two pressing rollers form a nip in which one log is rotated to seal the tail of the log.

In one embodiment, a multiprocessing apparatus for forming logs of a web material comprises a log-winding unit, a conveyor operable to deliver one winding core to the log-winding unit, a severing arm operable to cut out a tail of one log, a printing unit and a tail-processing unit. The printing unit is operable to transfer at least one printed pattern on an area of the web material corresponding to the tail of one log, wherein at least a part of the printed pattern includes one glue layer. The tail-processing unit is operable to press and seal the tail of one log.

In another embodiment, a process of forming a log of a web material is described. The process comprises winding a web material around a rotating winding core to form a log, severing the web material to form a tail of one wound log, printing a pattern on the tail of one log, wherein the printed pattern includes at least a glue layer, and pressing and sealing the tail on the log.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

Figure 1:
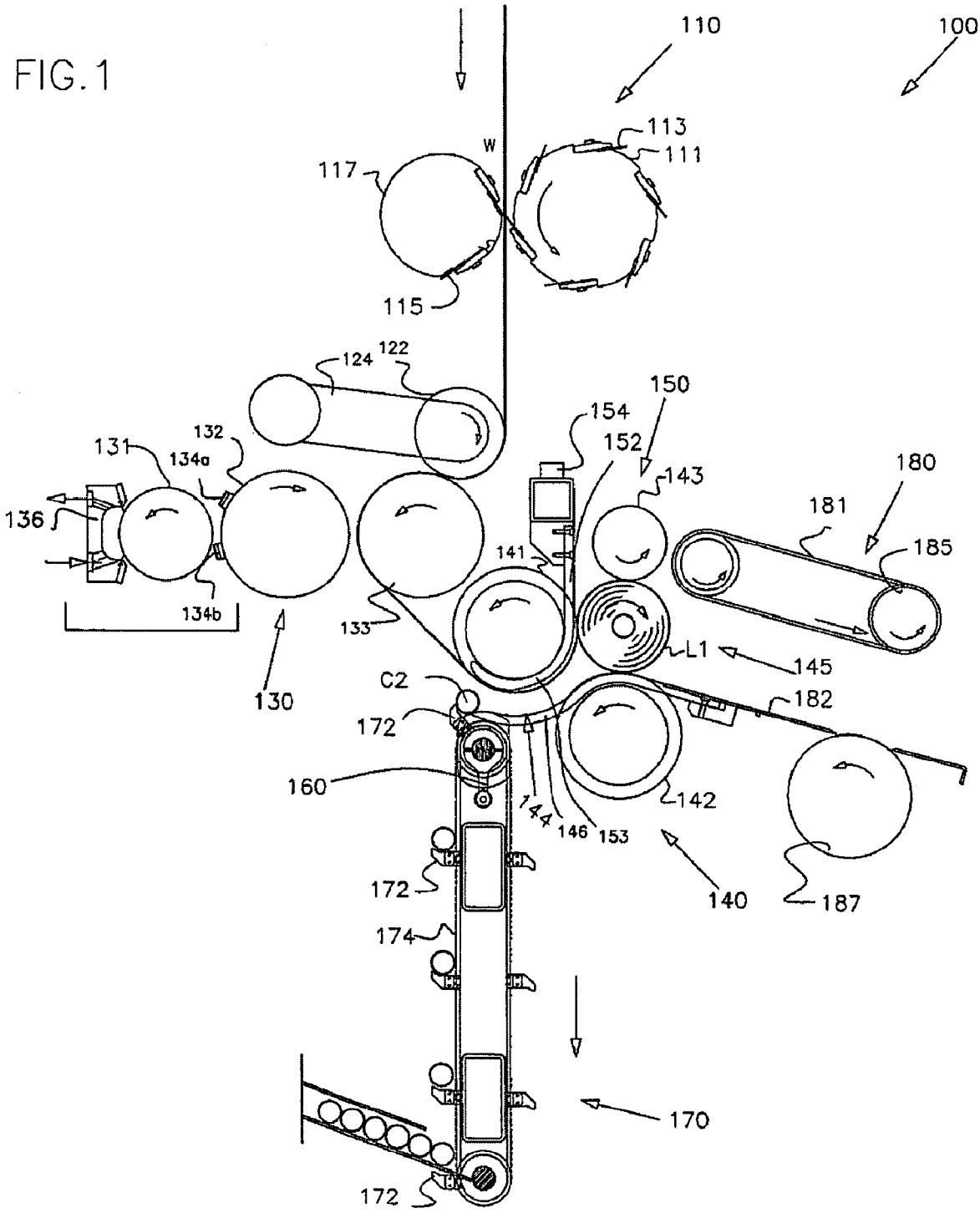
FIG. 1 is a general schematic view of a log multiprocessing apparatus according to an embodiment of the invention.

The present application describes a multiprocessing apparatus and a process of forming logs of a web material. The web of material can be made of tissue paper or any kinds of flexible materials that can be wound and processed into logs. In the drawings, similar reference numerals designate like elements unless otherwise described.

FIG. 1 is a general schematic view of a log multiprocessing apparatus according to an embodiment of the invention. Reference numeral 100 generally designates a log multiprocessing apparatus operable to form logs of web material with sealed tails. The apparatus 100 integrates many processing units, each of which is operable to perform specific functions so that the output of the apparatus 100 delivers complete logs of web materials with sealed tails.

Web material W inputted to the apparatus 100 passes through a perforator unit 110, which in this embodiment may have a perforating roller 111 with a plurality of blades 113 interacting with fixed blades 115 carried by a shaft 117. The perforator unit 110 is operable to form parallel perforation lines on the web material W.

Feeding roller 122 conveys the web material toward a glue applicator 130. The position of the feeding roller 122 can be adjusted via an actuating arm 124 so as to produce a suitable tension within the web material and thereby ensure that it is correctly fed downstream through the glue applicator 130 and, subsequently, to a log-winding unit 140.

In the illustrated embodiment, the glue applicator 130 is constructed as a printing unit. The glue applicator unit 130 includes a printing roller 132 interposed between a transfer roller 131 and a base roller 133, and a glue dispenser 136. The surface of the printing roller 132 is provided with one or more imprinting pads 134*a* and 134*b*. The transfer roller 131 is impregnated with glue supplied from the glue dispenser 136, and then transfers the glue to the imprinting pads 134*a* and 134*b* of the printing roller 132.

The printer roller 132 rotates in a direction opposite to that of the transfer roller 131 and base roller 133 so as to print patterns including glue layers on the web material W traveling through the printer roller 132 and base roller 133. Since a printing technique is used, both visible and invisible marks or logos of different colors may be formed on the web material wound around the winding core. An indenting technique may also be used to create indentations of marks or logos on the web material wound around the winding core without any inks or glues.

Figure 4:
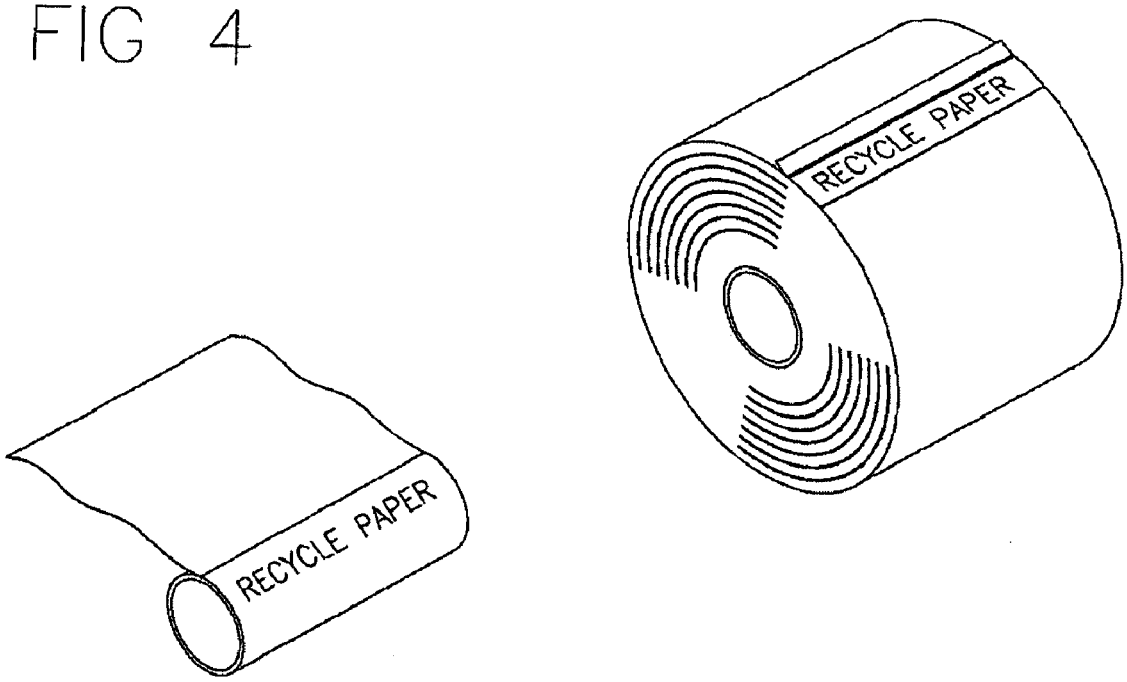
FIG. 4 is a schematic view of paper tissue logs exemplary produced according to an embodiment of the invention.

FIG. 4 is a schematic view of paper tissue logs exemplary produced with printed marks according to an embodiment of the invention. The imprinting pads 134*a* and 134*b* may be configured with a desired pattern design, such as "RECYCLE PAPER", to be visibly marked on the front and/or tail portions of the web material wound around a winding core. This may be achieved by, for example, dispensing colored glue on the imprinting pads 134*a* and 134*b*. Printing may also be done throughout the web material wound around the winding core, allowing a continuous patter of marks or logos.

Referring back to FIG. 1, the log-winding unit 140 includes three winding rollers 141, 142, and 143 that rotate about parallel axes and define a winding cradle 145 where a log L1 is wound. The web material W passes around the first winding roller 141 and travels through a throat 144 to wind a log L1 inside the winding cradle 145. The third winding roller 143 is movable from a position closer to the first and second winding rollers 141 and 142 when the log L1 is smaller to a position further away from the first and second winding rollers 141 and 142 as the diameter of the log L1 increases.

Figure 3:
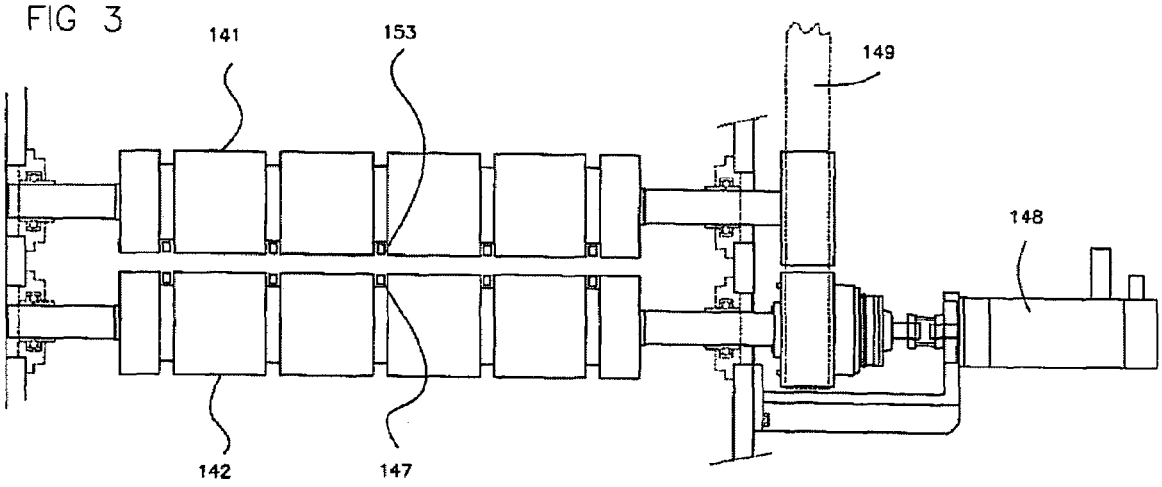
FIG. 3 is a schematic view illustrating the driving of the first and second winding roller according to an embodiment of the invention.

FIG. 3 is a schematic view illustrating a driving mechanism of the first and second winding roller according to an embodiment of the invention. Referring to FIGS. 1 and 3, a servomotor 148 drives the first and second winding rollers 141 and 142 in rotation via a driving belt 149. A rolling surface 146 (FIG. 1) extends along the throat 144 to guide the passage of winding cores toward the cradle 145 (FIG. 1). The rolling surface 146 includes a first portion approximately cylindrical and coaxial to the first winding roller 141, and terminates in a second portion 147 that passes through annular slots of the second winding roller 142. While the illustrated embodiment implements a log-winding unit based on an assembly of winding rollers, belts and other suitable winding mechanisms may be also implemented for the log-winding unit without departing from the inventive features of this application.

Referring back to FIG. 1, a severing unit 150 is mounted to sever the web material once one log L1 is completed. In the illustrated embodiment, the severing unit 150 includes a severing arm 152 movable via an actuator 154. The severing arm 152 can have curved portions 153 profiled to fit within slots of the first winding roller 141. The severing arm 152 can be actuated between two positions: a first position where the curved portion 153 of the arm 152 is retracted within the slots of the first winding roller 141, and a second position where it is deployed to thrust or move from a surface of the first winding roller 141 against the web material to sever it the web material. In the first position, the severing arm 152 may also be parallel to the surface of the first winding roller 141 or slightly above such a surface, so long as the severing arm 152 does not interfere with and sever the web material. In an alternative embodiment, the severing unit 150 includes a severing arm formed by extending the rolling surface 146. The extended rolling surface (not shown) can be actuated between two positions: a first position where it forms the throat 144 to be at least the diameter of the winding core C2 to allow the passage of the winding core C2, and a second position where it is deployed to thrust or move towards the first winding roller 141 against the web material to sever the web material.

A rotary core-urging arm 160 is configured to push and engage one winding core C2 in the throat 144. The core-urging arm 160 rotates synchronously to a rotation of the printing roller 132 so that the engagement of the winding core C2 in the throat 144 approximately corresponds to the passage of a portion of the web material provided with glue portions inside the throat 144.

Each winding core C2 is brought to the inlet of the throat 144 via a conveying mechanism 170 including one or more carrier finger 172. The carrier finger 172 moves cyclically along with a belt 174 to convey winding cores to the inlet of the throat 144. The conveying mechanism 170 may be of different shape so long as it brings winding core C2 to the inlet of the throat 144 to allow synchronous feeding of the winding core C2 to the throat 144 by the core-urging arm 160.

A tail-processing unit 180 is assembled downstream from the log-winding unit 140. The tail-processing unit 180 includes a conveyor belt 181, a guiding plate 182 and two opposite pressing rollers 185 and 187. The conveyor belt 181 drives the rolling of a log along the guiding plate 182 at a decelerated speed until it reaches the pressing rollers 185 and 187. The pressing rollers 185 and 187 rotate in a same direction, for example counterclockwise, and at a same speed to form a nip in which one log is pressed and kept rotating for a period of time to ensure that its tail provided with the glue adequately adheres on the log.

Figure 2A:
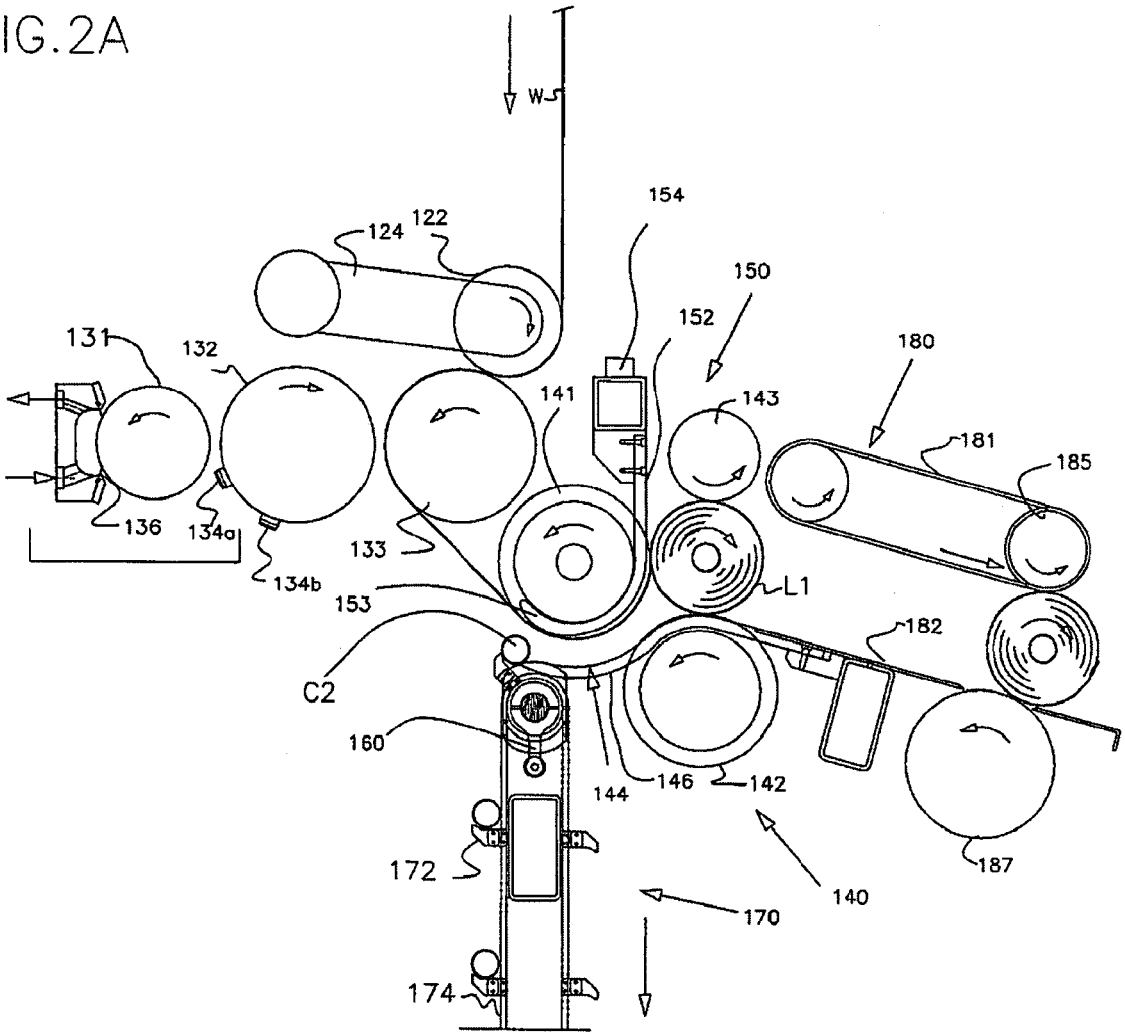
FIGS. 2A~2F are schematic views of a rewinding process implemented according to an embodiment of the invention.

FIGS. 2A~2F are schematic views of a rewinding process implemented according to an embodiment of the invention. In FIG. 2A, a log L1 is being wound inside the cradle 145 and a carrier finger 172 has conveyed a winding core C2 to the inlet of the throat 144 to form a next log. Log L1 is shown in a phase where its winding is almost completed, and the next winding core C2 is ready to be processed.

Figure 2B:
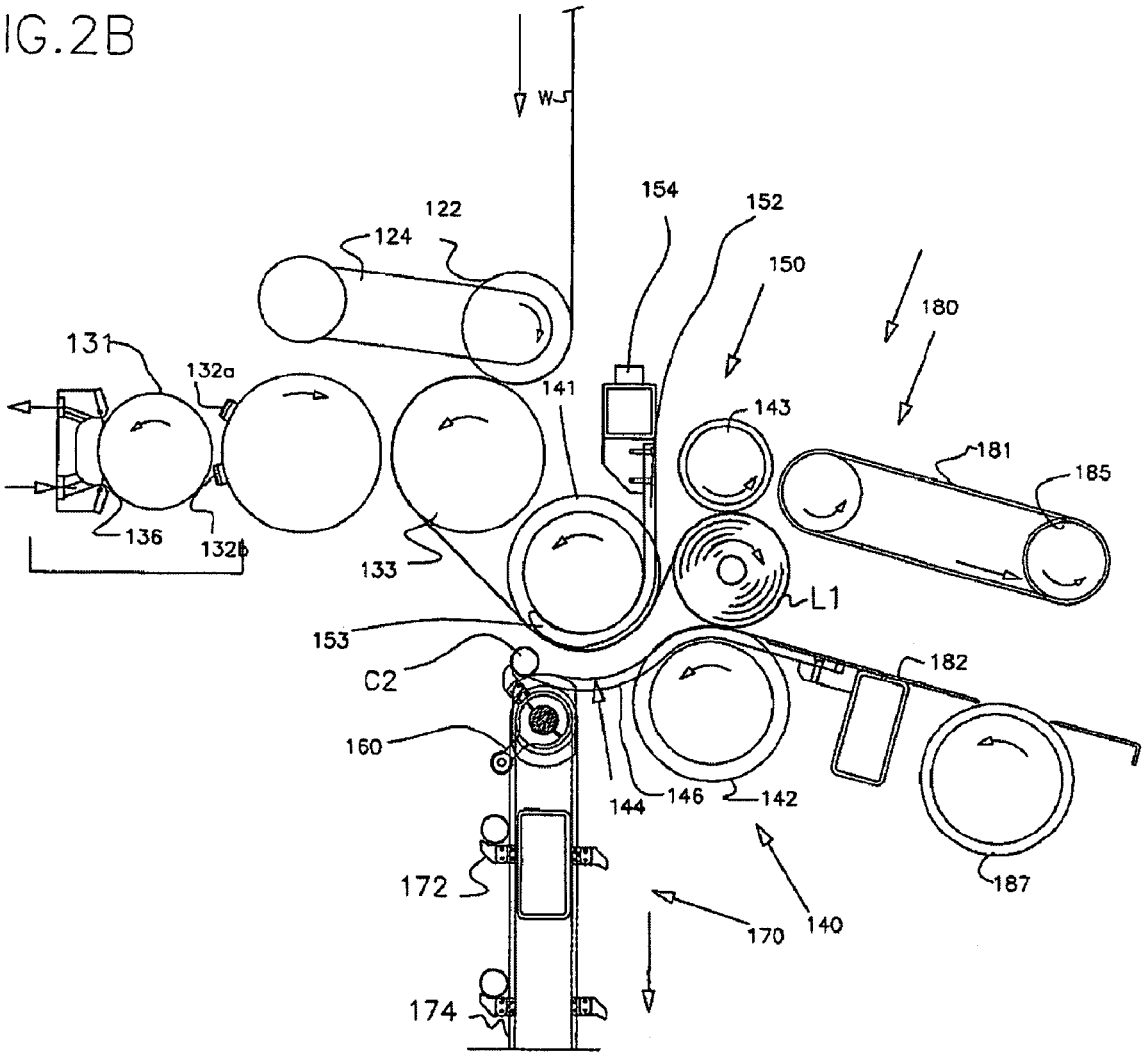

Referring to FIG. 2B, the log-winding unit 140 operates to start unloading the log L1 and tensioning the web material. This may be achieved via accelerating the third winding roller 143 to move the log L1 away from the surface of the first winding roller 141. Alternatively, detachment of the log L1 from the first winding roller 141 may also be performed via decelerating the second winding roller 142, or via a combined action of accelerating the third winding roller 143 and decelerating the second winding roller 142. In the meantime, the printing roller 132 is driven in rotation so that the imprinting pads 134*a* and 134*b* are impregnated with glue by contact with the transfer roller 131 and subsequently come to imprint glue portions on the web material.

In this embodiment, two imprinting pads 134*a* and 134*b* are provided: a first imprinting pad 134*a* for applying a first glue layer T on the tail of the web material being wound on the log L1, and a second imprinting pad 134*b* for applying a second glue layer F on an area of the web material to adhere on the next winding core C2. The two imprinting pads 134*a* and 134*b* are spaced away from each other at such a distance that the respective T and F glue layers are applied at two distant areas of the web material separated by at least one perforation line.

Figure 2C:
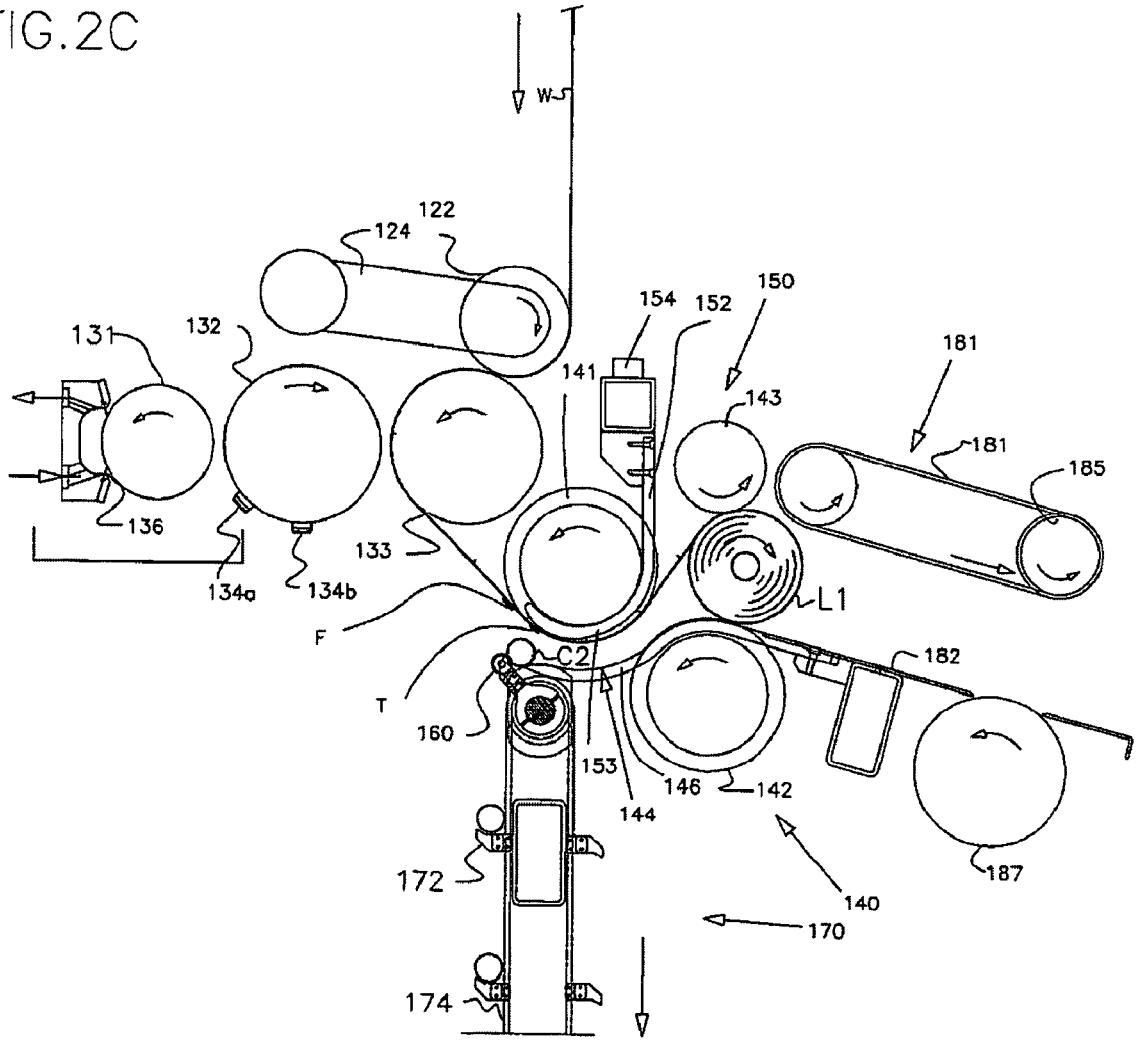

Referring to FIG. 2C, the core-urging arm 160 rotates to push and engage the winding core C2 in the throat 144, while the areas of the web material provided with glue layers T and F travel into the throat 144.

Figure 2D:
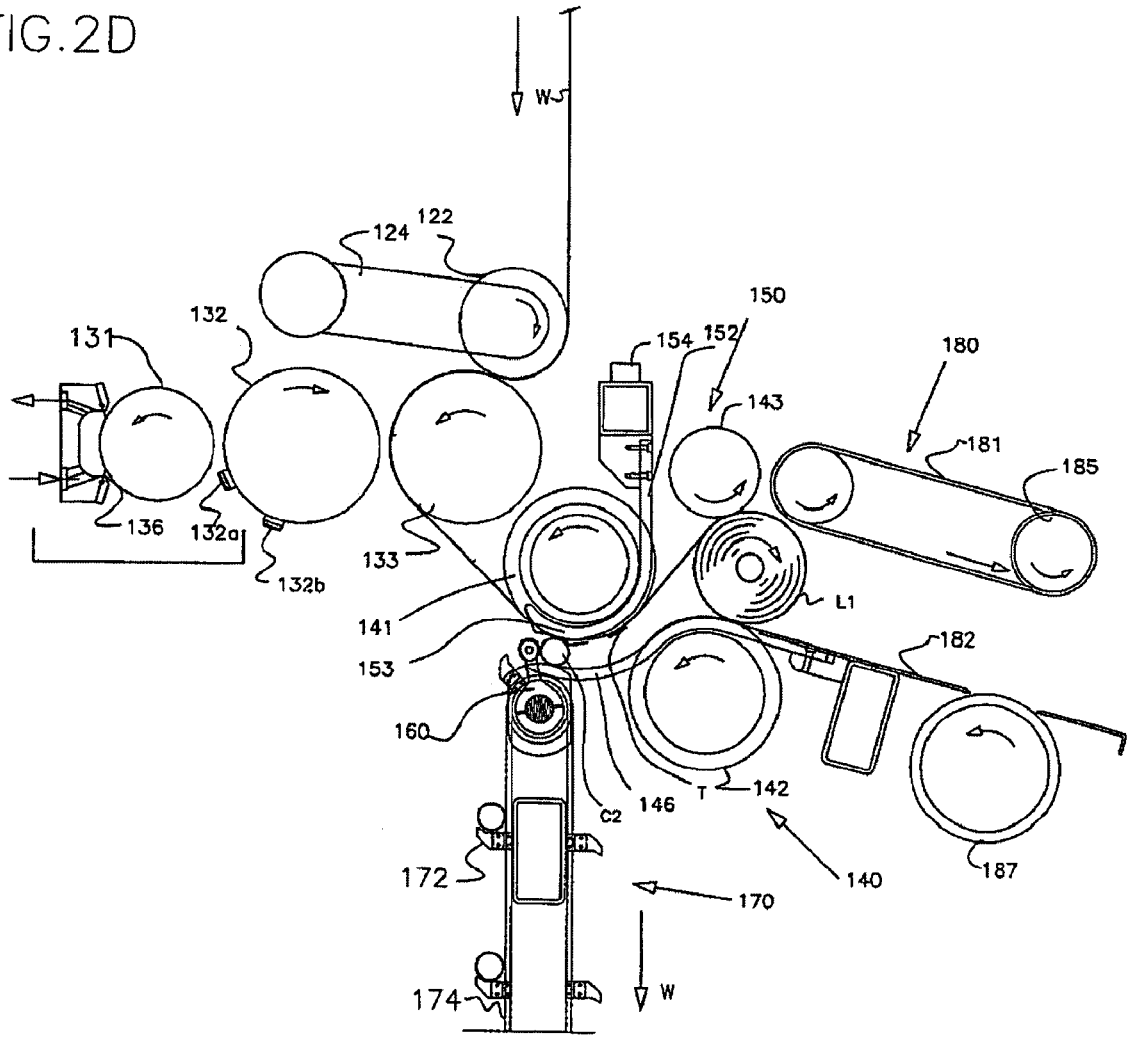

Referring to FIG. 2D, the severing arm 152 is actuated to urge against the web material fed around the first winding roller 141. The thrust of the severing arm 152 is approximately concurrent or slightly subsequent to the adhesion of the winding core C2 to the web material via the glue layer F as the winding core C2 and the glue layer F travel through the throat 144. As a result, the web material tears at a perforation line between the glue layer T and the glue layer F. The tail of the log L1 being cut out from the web material then is progressively wound around the log L1 as it rolls downstream.

Figure 2E:
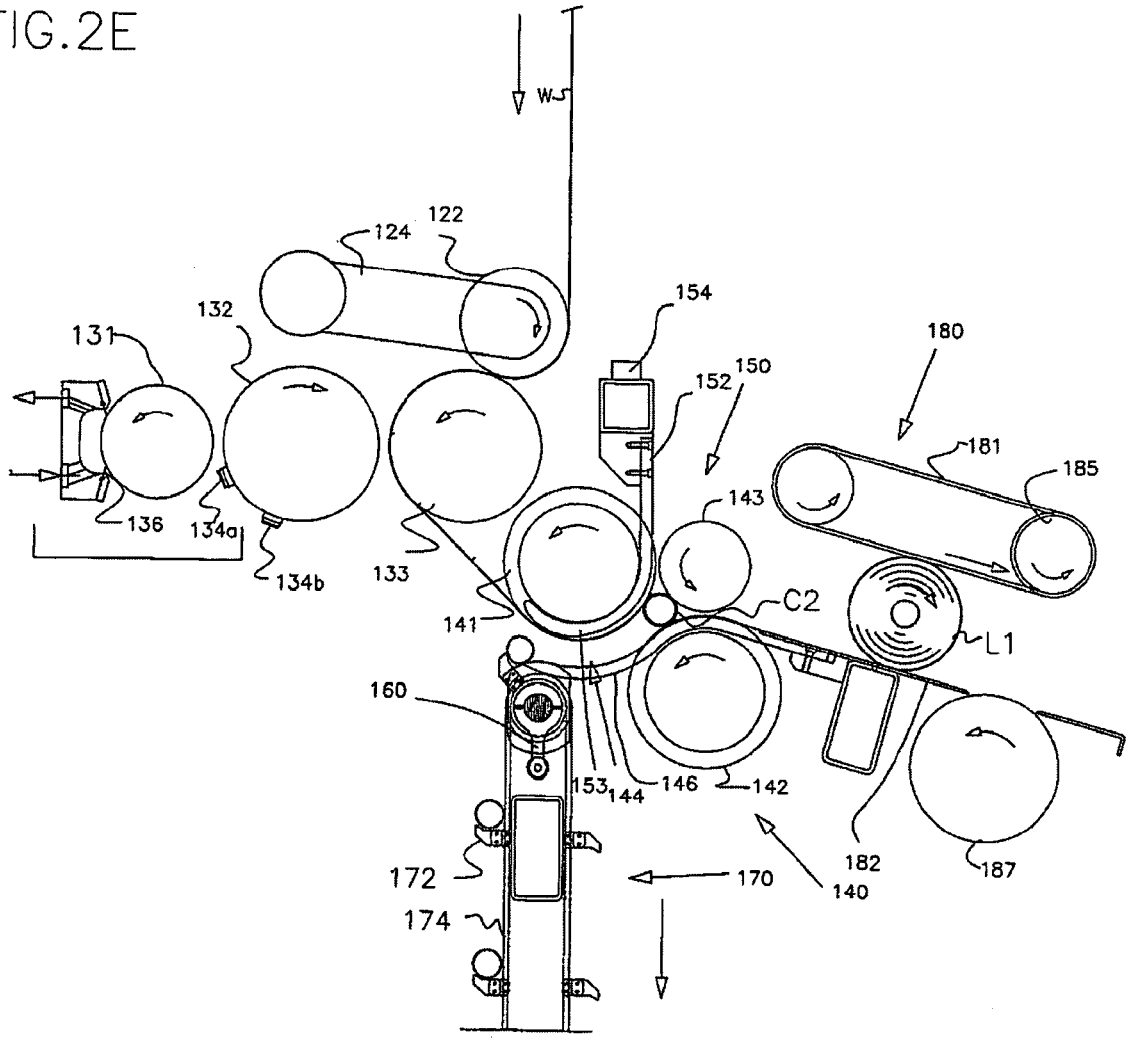

Referring to FIG. 2E, the winding core C2 rolls along the rolling surface 146 to reach the cradle 145 where a new winding cycle is conducted to form a new log. In the meantime, the conveyor belt 181 of the tail-processing unit 180 drives the rolling of the complete log L1 along the guiding plate 182 at a decelerated speed until it reaches the pressing rollers 185 and 187.

Figure 2F:
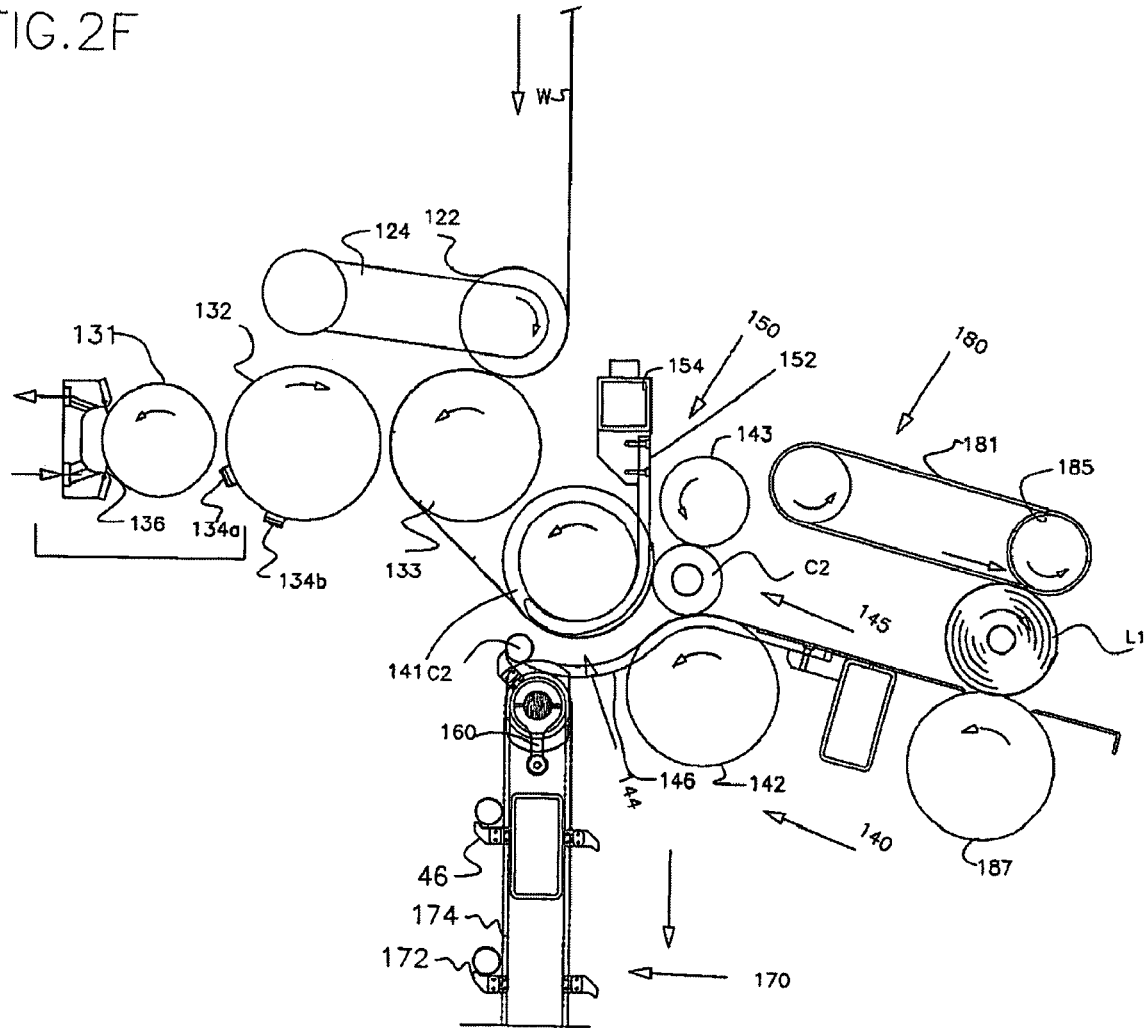

Referring to FIG. 2F, the pressing rollers 185 and 187 rotate in a same direction, for example counterclockwise, to form a nip in which the log L1 is pressed and kept rotating for a period of time to ensure that the glued tail adequately presses and adheres on the log L1. Subsequently, the rollers 185 and 187 are controlled to rotate at different speeds to release the log L1.

Figure 5:
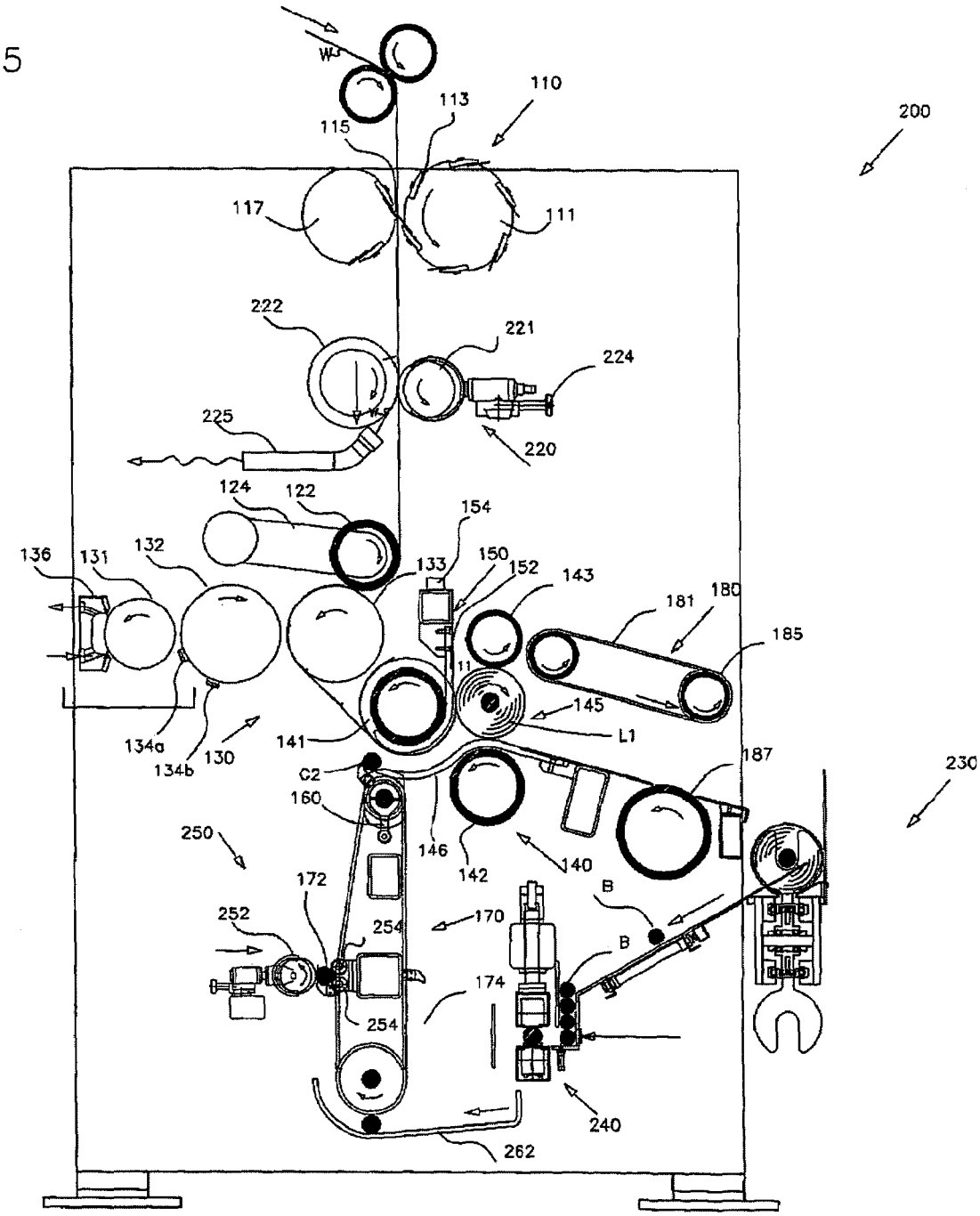
FIG. 5 illustrates a multiprocessing apparatus for forming logs of a web material according to another embodiment of the invention.

Many variations of the apparatus described in this invention may be envisioned according to the specific requirements of the final log product. FIG. 5 illustrates a multiprocessing apparatus for forming logs of a web material according to another embodiment of the invention.

In the variant embodiment of FIG. 5, the multiprocessing apparatus 200 is configured to form log sections of relatively small lengths without the need of a separate log-sawing station. To this end, the multiprocessing apparatus 200 includes the same processing units as disclosed above, and additionally incorporates the assembly of a slitting unit 220, shaft-disengaging unit 230, core-engaging unit 240 and core-cutting unit 250.

The slitting unit 220 includes rotary slitter blades 221 and a base blade 222 interacting with each other to sever a single continuous ribbon of web material into parallel strips of web material. The positions of the rotary slitter blades 221 are adjustable via an actuator 224 to set the width of each strip of web material and also move the slitter blades 221 relative to the base blade 222. A vacuum suction device 225 is operable to evacuate unwanted peripheral portions of the web material cut out by the slitter blades 221.

As shown in the embodiment of FIG. 5, the slitting unit 220 may be mounted between the perforator unit 110 and feeding roller 122 to cut the single ribbon web material into strips to be wound around winding cores.

The cut strips of web material are processed through the glue applicator 130, log-winding unit 140, and tail-processing unit 180 according to a processing sequence similar to that illustrated in FIG. 2A~2F.

Before it reaches the log-winding unit 140, a winding core C is mounted with a shaft B at the core-engaging unit 240, and subsequently cut in desired section lengths at the core-cutting unit 250.

Figure 6:
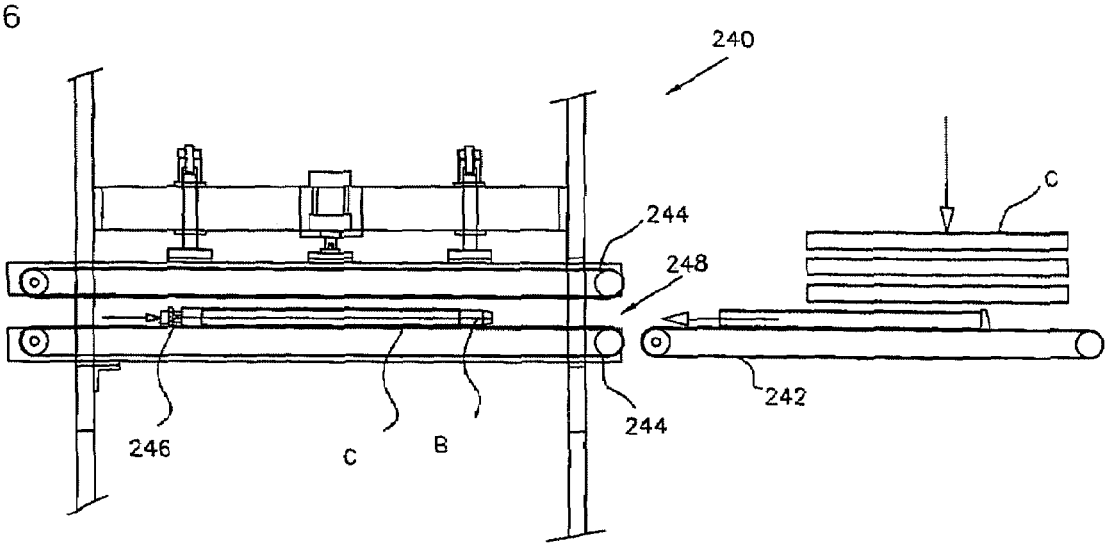
FIG. 6 is a schematic view of a core-engaging unit 240 according to an embodiment of the invention.

FIG. 6 is a schematic view of a core-engaging unit 240 according to an embodiment of the invention. The construction of the core-engaging unit 240 includes a conveying belt 242 over which winding cores C are stacked, and two parallel belt inserters 244 defining a gap 248 where a shaft B is inserted inside a winding core C. One or two of the belt inserters 244 may be actuated to move parallel away from or toward each other so as to enlarge or reduce the gap 248.

One shaft B to be inserted inside a winding core C is placed inside the gap 248 between the two belt inserters 244 and is stopped in the sliding direction of the belt inserts 244 by an abutment 246. The shaft B is positioned approximately aligned with a winding core C to mount in. The conveying belt 242 conveys the winding core C to engage and come into contact between the two belt inserters 244, which then drive the winding core C to longitudinally slide and engage with the shaft B.

As shown in FIG. 5, the winding core mounted with a shaft then is released on a plate 262 to roll toward the conveying mechanism 170 where it will be picked up by one carrier finger 172. The carrier finger 172 conveys the winding core to the core-cutting unit 250.

The core-cutting unit 250 includes a blade roller 252 and two positioning rollers 254 that form a nip where a winding core undergoes radial cutting to define core sections of given lengths S. The length S of each log section corresponds to the respective width of the strips of web material cut out from the slitting unit 220.

Figure 7:
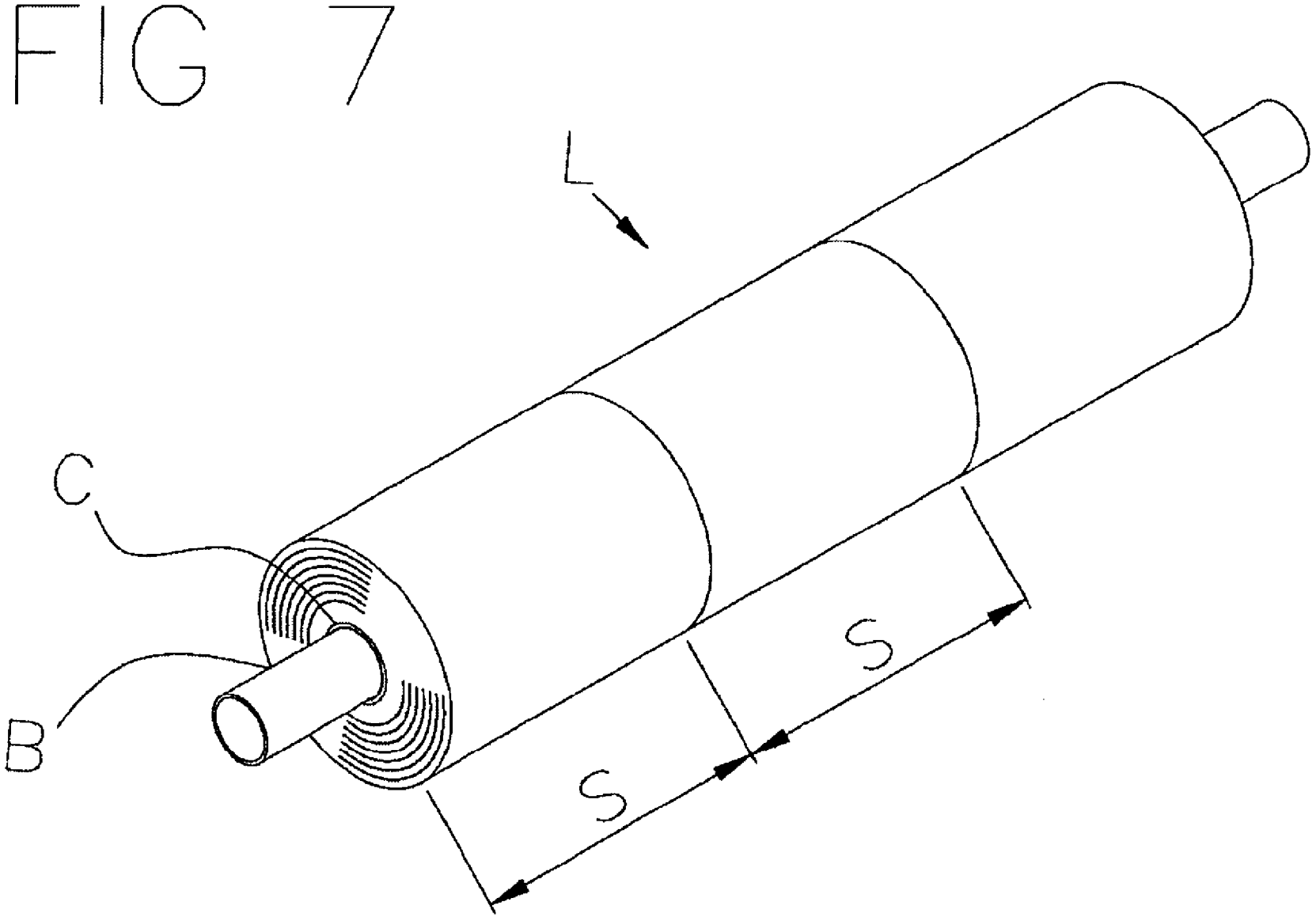
FIG. 7 is a schematic view of log sections formed according to an embodiment of the invention.

The winding core cut in core sections then is conveyed to the inlet of the throat 144 of the log-winding unit 140. After the winding core has been wound into a log and released from the tail-processing unit 180, the finally formed log includes log sections of the length S. FIG. 7 is a schematic view of a log L thereby formed according to an embodiment of the invention. No separate log sawing station thus is necessary. One log unloaded from the tail-processing unit 180 can travel to the shaft-disengaging unit 230 where the shaft is disengaged from the log sections. The released shaft can be redirected toward the core-engaging unit 240 to mount with a new winding core.

The skilled artisan will appreciate that the different processing units described in this application may be implemented in a single integrated system or independently implemented in separate processing stations according to the customer's demands. For example, when no marks or logos are desired, the printing roller 132 may simply act as a glue applicator.

Realizations in accordance with the present invention therefore have been described in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. An apparatus for loading a shaft into one hollow winding core suitable for winding a web material, comprising:

two parallel inserting belts opposing each other to define a loading gap there between; and an abutment separate from the shaft is disposed in the loading gap between the two inserting belts, wherein the abutment is configured to stop the shaft introduced in the loading gap;

wherein the inserting belts are operable to oppositely press against the winding core and slide the winding core over the shaft stopped in the loading gap.

2. The apparatus according to claim 1, wherein the inserting belts lie over a length overlapping with the shaft positioned in the loading gap.

3. The apparatus according to claim 1, wherein the two inserting belts are movable relative to each other to modify a distance between the two inserting belts.

4. The apparatus according to claim 1, further comprising a conveyor belt disposed upstream of the two inserting belts, wherein the conveyor belt is configured to transfer the winding core along a direction parallel with the inserting belts into the loading gap.

5. A multiprocessing apparatus for forming logs of a web material, comprising:

a log-winding unit operable to wind a log of a web material around a winding core;

a first conveyor operable to deliver the winding core to the log-winding unit; and a shaft-loading unit operable to insert an elongated shaft inside the winding core to be wound with the web material, wherein the shaft-loading unit includes:

two parallel inserting belts opposing each other to define a loading gap there between;

a positioning element configured to position the shaft in the loading gap; and a second conveyor configured to deliver the winding core to the inserting belts;

wherein the positioning element includes an abutment separate from the shaft that is disposed in the loading gap between the two inserting belts and is adapted to stop the shaft in the loading gap; and wherein the inserting belts are configured to oppositely press against the winding core while sliding the winding core over the positioned shaft.

6. The apparatus according to claim 5, wherein the log-winding unit includes a plurality of rotary winding elements.

7. The apparatus according to claim 5, wherein the inserting belts lie over a length overlapping with the shaft.

8. The apparatus according to claim 5, wherein the two inserting belts are movable relative to each other to modify a distance between the two inserting belts.

9. The apparatus according to claim 5, wherein the second conveyor is configured to move the winding core along a direction parallel with the inserting belts.

* * * * *